US006305302B2

(12) United States Patent
Kleiss

(10) Patent No.: US 6,305,302 B2
(45) Date of Patent: Oct. 23, 2001

(54) WASTE TIRE GASIFICATION IN A NEGATIVE AMBIENT PRESSURE ENVIRONMENT

(75) Inventor: Richard L. Kleiss, Gladwin, MI (US)

(73) Assignee: Waste Tire Gas Technologies, Inc., Las Vegas, NV (US)

( * ) Notice: Subject to any disclaimer, the term of this patent is extended or adjusted under 35 U.S.C. 154(b) by 0 days.

(21) Appl. No.: 09/755,852

(22) Filed: Jan. 6, 2001

Related U.S. Application Data

(63) Continuation-in-part of application No. 09/395,860, filed on Sep. 14, 1999.

(51) Int. Cl.[7] ..... F23J 3/00; F23B 5/00; F23G 7/06

(52) U.S. Cl. ..... 110/210; 110/229; 110/344; 110/346; 110/235

(58) Field of Search ..... 110/119, 120, 110/121, 127, 147, 229, 210, 345, 208, 235, 344, 346

(56) References Cited

U.S. PATENT DOCUMENTS

| | | | | |
|---|---|---|---|---|
| 1,182,863 | * | 1/1916 | Toussaint | 110/162 |
| 2,282,256 | * | 5/1942 | Smelik | 230/117 |
| 3,756,171 | * | 9/1973 | De Bord | 110/8 R |
| 4,063,521 | * | 12/1977 | Pech | 110/8 A |
| 4,402,738 | * | 9/1983 | Akio | 75/44 S |
| 4,430,950 | * | 2/1984 | Foresto | 110/235 |
| 4,759,300 | * | 7/1988 | Hansen et al. | 110/229 |
| 4,919,686 | * | 4/1990 | Edwards | 48/197 R |
| 5,101,739 | * | 4/1992 | Nance et al. | 110/229 |
| 5,426,259 | * | 6/1995 | Hojo et al. | 585/240 |
| 5,445,087 | * | 8/1995 | Kaneko | 110/235 |
| 5,477,790 | * | 12/1995 | Foldyna et al. | 110/346 |
| 5,611,289 | * | 3/1997 | Brookes | 110/194 |
| 5,616,995 | * | 4/1997 | Hollenbeck | 318/432 |
| 5,619,938 | * | 4/1997 | Kaneko | 110/346 |
| 5,826,520 | * | 10/1998 | Mainord | 110/342 |
| 6,000,935 | * | 12/1999 | Regimand et al. | 432/72 |

* cited by examiner

*Primary Examiner*—Henry Bennett
*Assistant Examiner*—K. B. Rinehart
(74) *Attorney, Agent, or Firm*—Donald J. Ersler

(57) ABSTRACT

An apparatus for providing waste tire gasification in a negative ambient pressure environment includes a gasification unit, a combustion unit, and a connection pipe. The gasification unit includes a gasification chamber, at least one air vent, at least one gasification igniter, and a fan. The combustion unit includes a combustion chamber, and an exhaust pipe. The connection pipe connects the output of the gasification unit with the combustion unit. In operation, tires are placed inside the gasification chamber. The tires are ignited using the gasification igniter. The rapid oxidation of the tires is fed with the air entering the at least one air vent. Combustion gases generated from the oxidizing tires are pulled out of the gasification chamber through a vacuum pipe with the fan. The gases are pushed through the connection pipe in to the combustion chamber. The combustion gases are ignited in the combustion chamber with at least one combustion igniter.

8 Claims, 3 Drawing Sheets

WASTE TIRE GASIFICATION IN A NEGATIVE AMBIENT PRESSURE ENVIRONMENT

CROSS-REFERENCES TO RELATED APPLICATIONS

This is a continuation-in-part application of Ser. No. 09/395,860 filed on Sep. 14, 1999.

BACKGROUND OF THE INVENTION

1. Field of the Invention

The present invention relates generally to the disposal of tires and more specifically to waste tire gasification in a negative ambient pressure environment which controls the oxidizing environment in a gasification chamber to greatly reduce the possibility of pre-detonation, and to control the density of combustion gases.

2. Discussion of the Prior Art

Disposal of discarded tires is a problem encountered everywhere. There are numerous tire burners on the market which range from large capacity incineration units to smaller units used as a heat source. The drawback to the smaller units is the possibility of pre-detonation in the gasification chamber, the generation of combustion gases in a pressurized environment, the lack of control of generated combustion gases, and air forced into tire burner adjacent the gasification chamber.

Air forced into the tire burner adjacent the gasification chamber increases the probability of pre-detonation therein. Forcing air into the tire burner creates a gasification chamber which operates under pressurized conditions. Some of the air forced into the gasification chamber will blow past the flame and not be consumed thereby. The "blow-by" air will inhibit precise combustion gas density. When predetonation does occur, the tire burner must be turned off for several hours to allow thereof to cool down. A gasification chamber which operates under pressure is less safe than one which operates at a negative ambient pressure.

Accordingly, there is a clearly felt need in the art for waste tire gasification in a negative ambient pressure environment which controls the oxidizing environment in the gasification chamber to greatly decrease the possibility of pre-detonation, and to precisely control the density of combustion gases.

SUMMARY OF THE INVENTION

The present invention provides waste tire gasification in a negative ambient pressure environment to greatly reduce the possibility of pre-detonation, and to control the quantity of combustion gases. An apparatus for providing waste tire gasification in a negative ambient pressure environment includes a gasification unit, a combustion unit, and a connection pipe. The gasification unit includes a gasification chamber, at least one air vent, at least one gasification igniter, and a fan. The combustion unit includes a combustion chamber, and an exhaust pipe. The connection pipe connects an outlet of the gasification unit with an inlet of the combustion unit. A combustion igniter is preferably disposed in the connection pipe at substantially an inlet of the combustion chamber.

In operation, tires are placed inside the gasification chamber. The tires are ignited using the at least one gasification igniter. Each gasification igniter is mounted in a gasification ignition port. To start ignition of the tires, the gasification igniter is turned on. When the tires have begun to burn, the at least one gasification igniter is turned off, removed from its respective gasification ignition port, and each gasification ignition port sealed. Air enters the gasification chamber at or below the smolder line of the tires through the at least one air vent. The rapid oxidation of the tires is fed with the air entering the at least one air vent.

The combustion gases generated from the oxidizing tires are pulled out of the gasification chamber through a vacuum pipe with the fan. The combustion gases are pushed through the connection pipe in to the combustion chamber. The combustion gases are ignited in the combustion chamber with the combustion igniter. The ignited gases may be used to heat a boiler or used for any other purpose. Other types of solid fuel besides tires may also be used.

Accordingly, it is an object of the present invention to provide an apparatus for providing waste tire gasification in a negative ambient pressure environment which greatly reduces the probability of pre-detonation in the gasification chamber.

It is a further object of the present invention to provide an apparatus for providing waste tire gasification in a negative ambient pressure environment which accurately controls the quantity of combustion gases.

It is yet a further object of the present invention to provide an apparatus for providing waste tire gasification in a negative ambient pressure environment which accurately controls the quality of combustion gases.

It is yet a further object of the present invention to provide an apparatus for providing waste tire gasification in a negative ambient pressure environment which does not operate under a pressurized environment.

It is yet a further object of the present invention to provide an apparatus for providing waste tire gasification in a negative ambient pressure environment which provides air as needed to the oxidizing tires.

Finally, it is another object of the present invention to provide an apparatus for providing waste tire gasification in a negative ambient pressure environment which utilizes discarded tires as a clean energy source.

These and additional objects, advantages, features and benefits of the present invention will become apparent from the following specification.

DETAILED DESCRIPTION OF THE PREFERRED EMBODIMENTS

Figure 3:
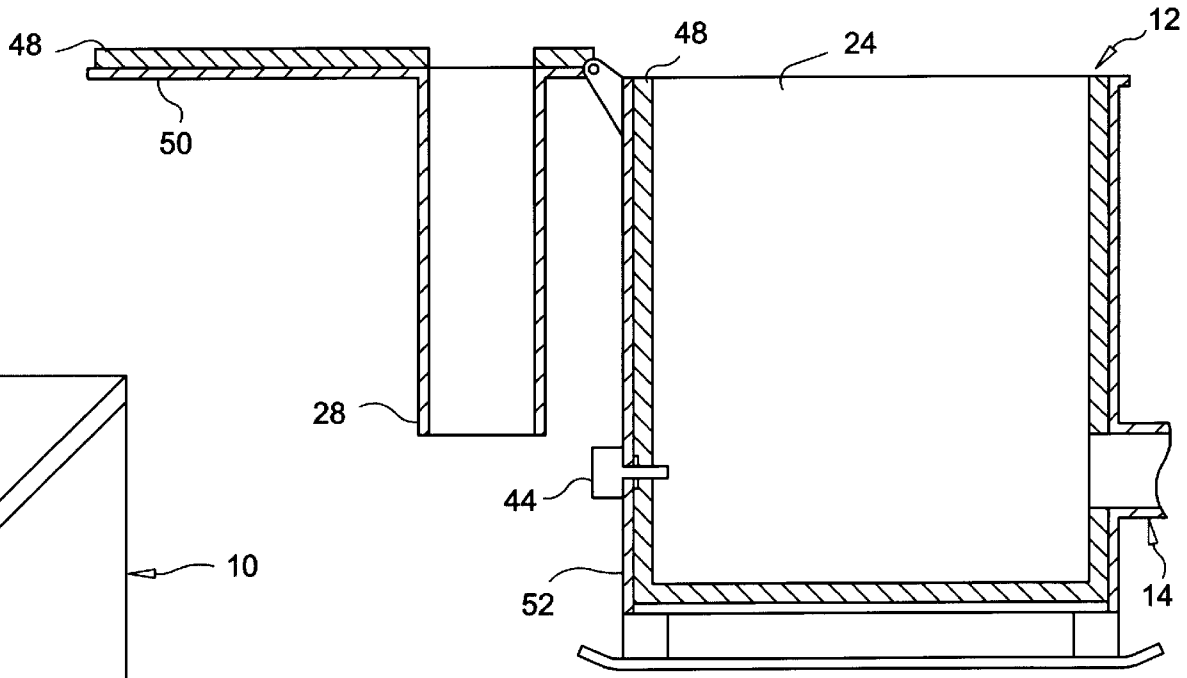
FIG. 3 is a cross sectional view of the combustion unit in accordance with the present invention.
Figure 1:
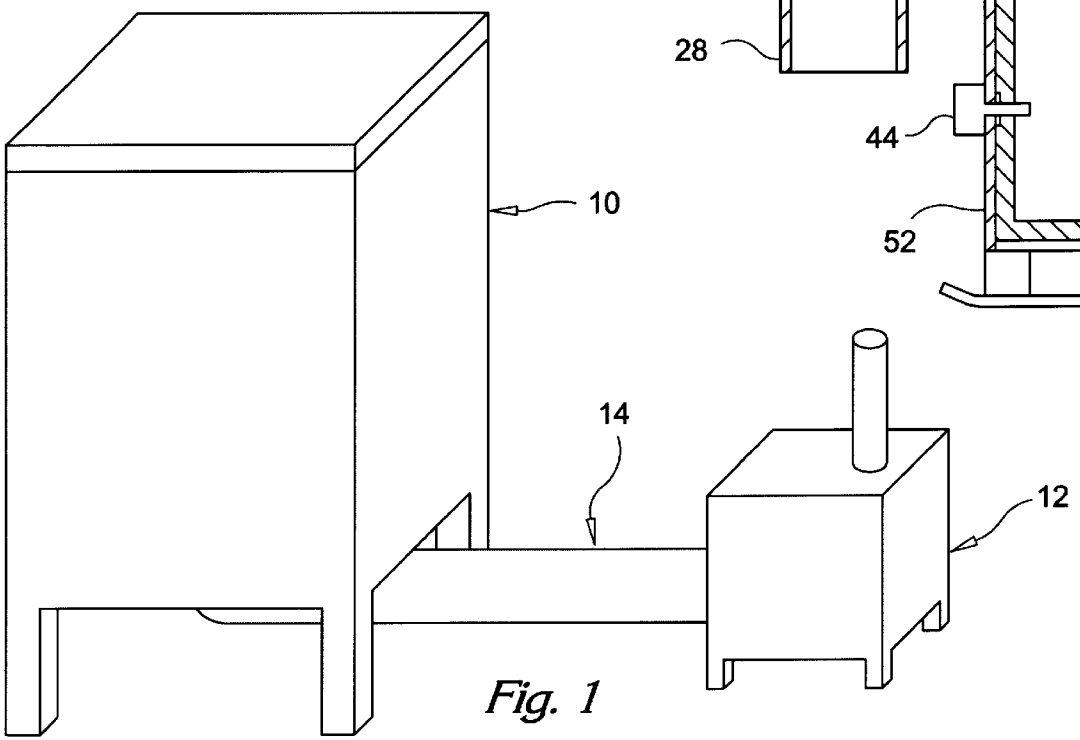
FIG. 1 is a perspective view of an apparatus for providing waste tire gasification in a negative ambient pressure environment in accordance with the present invention.
Figure 2:
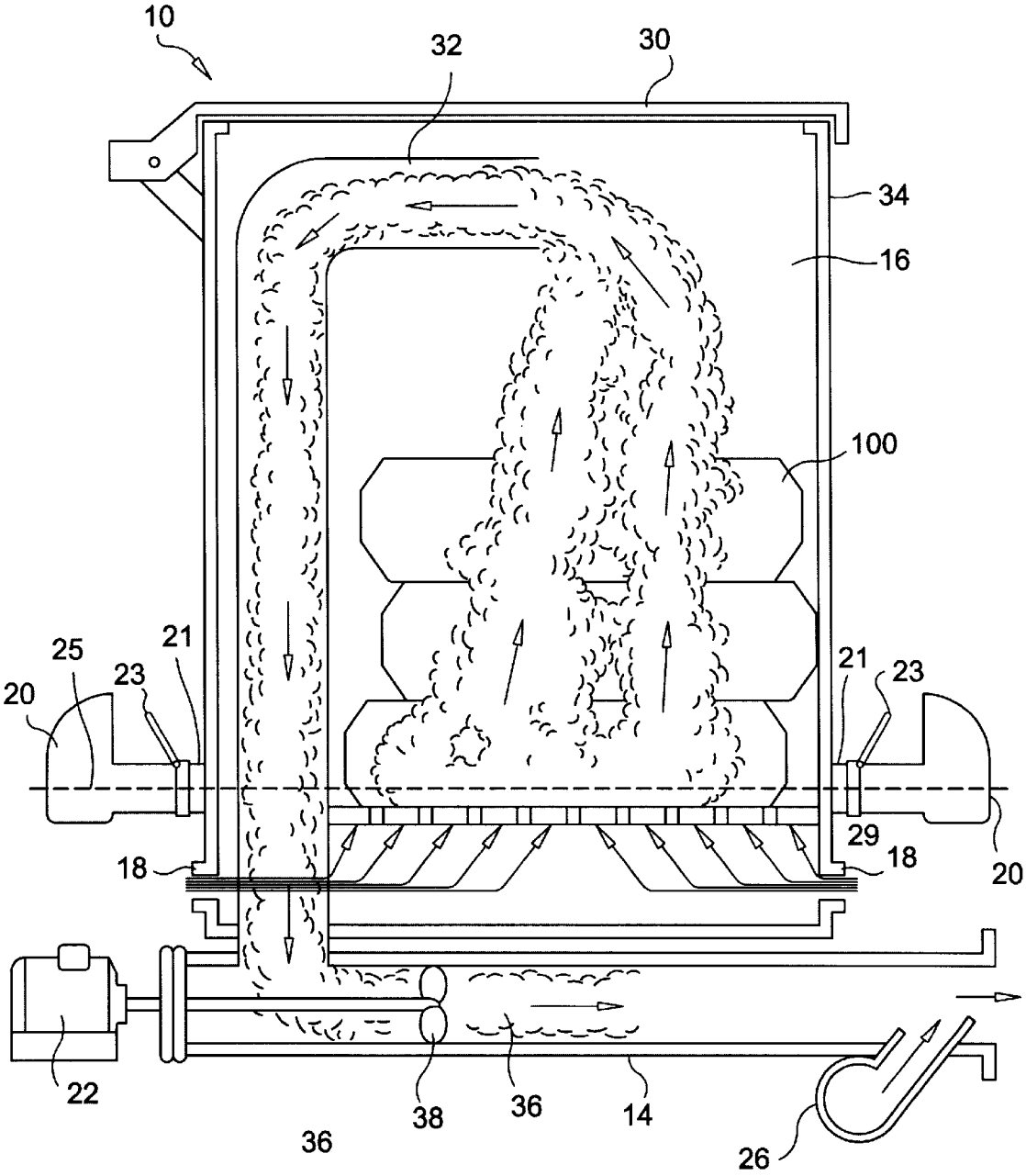
FIG. 2 is a cross sectional view of a gasification unit in accordance with the present invention.

With reference now to the drawings, and particularly to FIG. 1, there is shown a perspective view of a waste tire gasification apparatus 1. With reference to FIGS. 2 and 3, the waste tire gasification apparatus includes a gasification unit 10, a combustion unit 12, and a connection pipe 14. The gasification unit 10 includes a gasification chamber 16, at least one air vent 18, at least one gasification igniter 20, and a fan 38. The gasification igniter 20 includes an electric spark igniter, an accelerant squirter, and an air blower. The gasification igniter 20 is well known in the art. The gasification igniter 20 squirts accelerant on the tires 100. Scrap oil is preferably used as the accelerant, but other substances may also be used. The gasification igniter then provides electric spark ignition for starting the rapid oxidation of the accelerant. The tires 100 may also be ignited using any other suitable method.

Each gasification igniter 20 is mounted in a gasification ignition port 21. Preferably, when the tires have begun to burn, the at least one gasification igniter 20 is turned off, removed from its respective gasification ignition port 21, and each gasification ignition port 21 sealed. The gasification ignition port 21 is preferably sealed with a swing lid 23, but may be sealed with any other suitable method. Once the gasification ignition ports 21 are sealed, air enters the gasification chamber at or below the smolder line 25 of the tires 100 through the at least one air vent 18.

Figure 4:
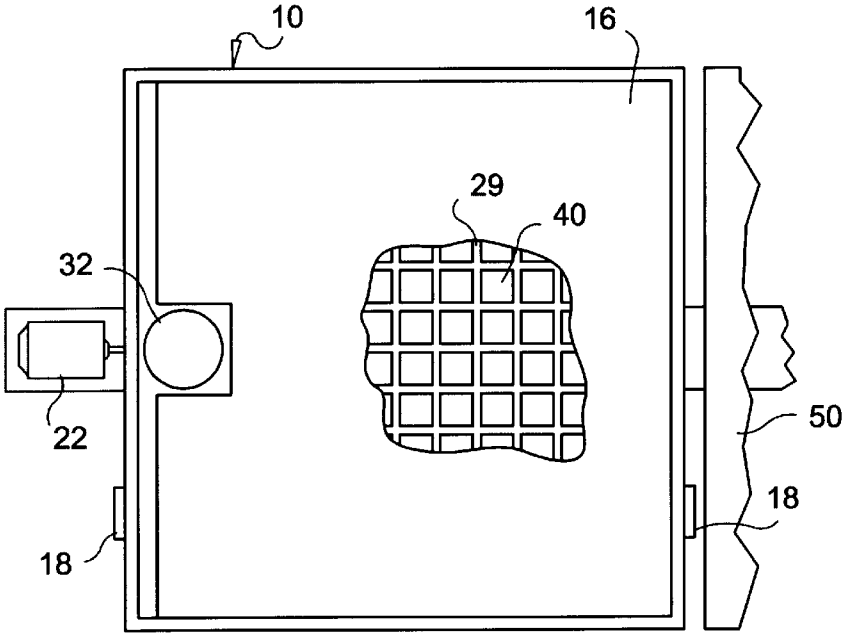
FIG. 4 is a top view of the gasification unit with the lid off in accordance with the present invention.

The smolder line 25 is a theoretical line drawn at a bottom of the oxidation. FIG. 4 shows a top view of the support grate 29. The air may enter the gasification chamber through the openings 40 in the support grate 29. The at least one air vent 18 may also be located above the support grate 29. The support grate 29 is preferably fabricated in several sections to allow thereof to be easily removed from the gasification chamber 16.

Preferably, walls 34 of the gasification chamber 16 and a gasification lid 30 are insulated to prevent heat loss. The gasification lid 30 is preferably pivotally attached to one of the walls 34. The gasification lid 30 does not have to be secured to a top of the gasification chamber 16, because the tires 100 are burned in a negative ambient environment. A vacuum pipe 32 is formed within the gasification chamber 16. Combustion gases 36 generated from the rapid oxidation of the tires 100 are drawn through the vacuum pipe 32 and pulled out through the connection pipe 14 with the fan 38. The fan 38 is driven by a motor 22. The air drawn through the at least one air vent 20 does not mix with the gases 36.

Figure 5:
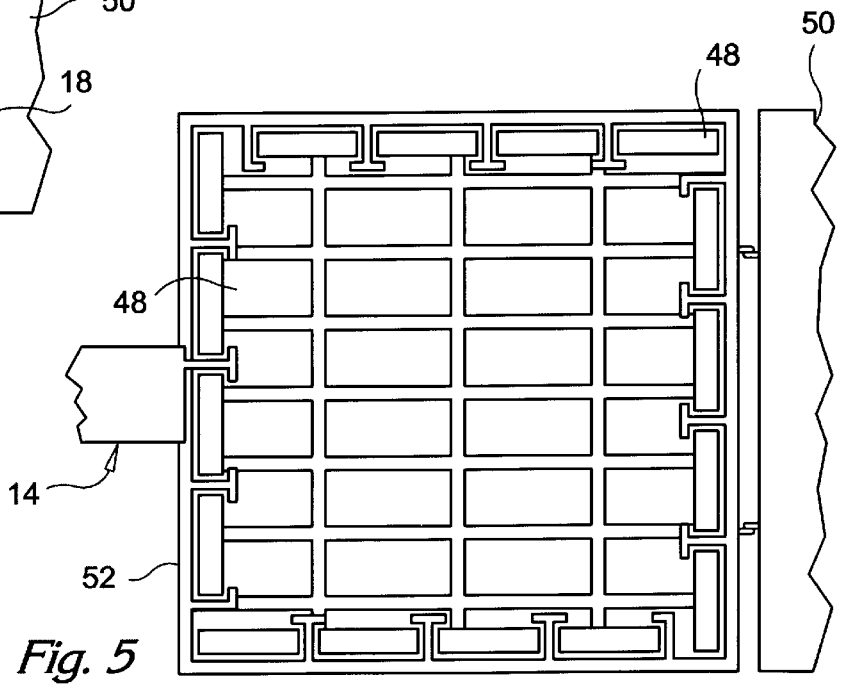
FIG. 5 is a top view of the combustion unit with the lid opened in accordance with the present invention.

The combustion unit 12 includes a combustion chamber 24, an exhaust pipe 28, and a combustion lid 50. The connection pipe 14 connects the gases 36 output from the vacuum pipe 32 to the combustion chamber 24 of the combustion unit 12. A check valve is not needed in the connection pipe 14 at the entrance of the combustion chamber 24; the pressure created in front of the fan 38 and the lack of air in the gasification chamber 16 will make detonation in the gasification chamber 16 very difficult. With reference to FIG. 5, walls 52 of the combustion chamber 24 are preferably lined with heat blocks 48 and the combustion lid 50 has a layer of heat blocks 48 disposed on a bottom thereof. The exhaust pipe 28 is preferably disposed in the insulated lid 50. The exhaust pipe 28 may be connected to any suitable source which requires the input of heat, such as a boiler. The exhaust pipe 28 may also be used to vent the by-products of the combusted gases.

A combustion igniter 26 is preferably disposed in the connection pipe 14 at substantially an inlet of the combustion chamber 24. The combustion igniter 26 includes an electric spark igniter and an air blower. The air blower provides a flow of air which mixes with the combustion gases 36. The electric spark igniter provides ignition to the gas/air mixture in the combustion chamber 24. At least one supplemental combustion igniter 44 may be used to provide supplemental electric spark ignition to the gas/air mixture in the combustion chamber. The at least one secondary combustion igniter 44 is preferably mounted on a wall 52 of the combustion chamber.

In operation, the tires 100 are placed inside the gasification chamber 16. Rapid oxidation of the tires 100 is started with the gasification igniter 20. Preferably, after the tires 100 have started oxidizing and the temperature inside the gasification chamber reaches approximately 400 degrees fahrenheit, the at least one combustion igniter 20 is removed from each gasification ignition port 21. The combustion gases 36 generated from the oxidizing tires 100 are pulled through the vacuum pipe 32 with the fan 38. The combustion gases 36 pass through the connection pipe 14 to the combustion chamber 24. The combustion gases 36 are ignited in the combustion chamber 24 with the combustion igniter 26 and if utilized, the at least one supplemental combustion igniter 44. The hot ignited gases are vented through the exhaust pipe 28. The residue from the tires 100 after oxidation is nontoxic and may be easily scraped off the walls 34 of the gasification chamber 16. Control of the igniters may be handled manually or through automation.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. An apparatus for providing waste tire gasification in a negative ambient pressure environment comprising:

a gasification chamber sized to retain a solid fuel source;

at least one gasification igniter removably attachable to said gasification chamber, said gasification igniter providing an initial flow of forced air to aid the oxidation of the solid fuel source, said forced flow being stopped once the solid fuel source is thoroughly oxidizing;

a vacuum pipe having an inlet connected to said gasification chamber;

a combustion chamber having a gas inlet and a separate air inlet adjacent said gas inlet;

a connection pipe being connected to said vacuum pipe on one end and to said combustion chamber on the other end thereof; and a fan disposed in said connection pipe after said vacuum pipe, rotation of said fan creating a vacuum such that combustion gases generated by the oxidation of the solid fuel source in said gasification chamber are pushed into said combustion chamber, said combustion gases being ignited in said combustion chamber; and a combustion igniter being disposed at substantially said inlet of said combustion chamber, said combustion igniter including an air blower and igniter, air being supplied by said air blower and said igniter providing ignition of the combustion gases in said combustion chamber.

2. The apparatus for providing waste tire gasification in a negative ambient pressure environment of claim 1, further comprising:

at least one supplemental combustion igniter being disposed in a wall of said combustion chamber to supplement the ignition of the combustion gases in said combustion chamber.

3. The apparatus for providing waste tire gasification in a negative ambient pressure environment of claim 1, further comprising:

said at least one gasification igniter squirting an accelerant on said solid fuel and igniting thereof.

4. The apparatus for providing waste tire gasification in a negative ambient pressure environment of claim 1, further comprising:

said fan being driven by a motor.

5. An apparatus for providing waste tire gasification in a negative ambient pressure environment comprising:

a gasification chamber sized to retain a solid fuel source;

at least one gasification igniter removably attachable to said gasification chamber, said gasification igniter providing an initial flow of forced air to aid the oxidation of the solid fuel source, said forced flow being stopped once the solid fuel source is thoroughly oxidizing;

a vacuum pipe having an inlet connected to said gasification chamber;

a combustion chamber having a gas inlet and a separate air inlet adjacent said gas inlet;

a connection pipe being connected to said vacuum pipe on one end and to said combustion chamber on the other end thereof; and a fan disposed in said connection pipe after said vacuum pipe, rotation of said fan creating a vacuum such that combustion gases generated by the oxidation of the solid fuel source in said gasification chamber are pushed into said combustion chamber, said combustion gases being ignited in said combustion chamber;

a combustion igniter being disposed at substantially said inlet of said combustion chamber, said combustion igniter including an air blower and igniter, air being supplied by said air blower and said igniter providing ignition of the combustion gases in said combustion chamber; and at least one air vent being formed at or below the oxidizing solid fuel source, the oxidizing of the solid fuel source being supplied with air through said at least one air vent.

6. The apparatus for providing waste tire gasification in a negative ambient pressure environment of claim 5, further comprising:

at least one supplemental combustion igniter being disposed in a wall of said combustion chamber to supplement the ignition of the combustion gases in said combustion chamber.

7. The apparatus for providing waste tire gasification in a negative ambient pressure environment of claim 5, further comprising:

said at least one gasification igniter squirting an accelerant on said solid fuel and igniting thereof.

8. The apparatus for providing waste tire gasification in a negative ambient pressure environment of claim 5, further comprising:

said fan being driven by a motor.

* * * * *